United States Patent [19]

Venable

[11] Patent Number: 4,832,384

[45] Date of Patent: May 23, 1989

[54] LATCH ASSEMBLY

[75] Inventor: Phillip G. Venable, Joliet, Ill.

[73] Assignee: J. I. Case Company, Racine, Wis.

[21] Appl. No.: 152,995

[22] Filed: Feb. 8, 1988

[51] Int. Cl.[4] ..... E05C 3/14

[52] U.S. Cl. ..... 292/87; 292/DIG. 38; 292/DIG. 30; 292/DIG. 63

[58] Field of Search ..... 292/DIG. 30, DIG. 38, 292/DIG. 63, 80, 86, 87, 89

[56] References Cited

U.S. PATENT DOCUMENTS

| | | | |
|---|---|---|---|
| 2,206,049 | 7/1940 | Richardson | 292/80 X |
| 2,358,607 | 9/1944 | Tinnerman | 292/87 |
| 2,879,561 | 3/1959 | Rieder | 292/87 X |
| 3,985,380 | 10/1976 | Raivio | 292/DIG. 38 X |
| 4,313,280 | 2/1982 | Ehret et al. | 292/87 X |
| 4,542,924 | 9/1985 | Brown et al. | 292/87 |

*Primary Examiner*—Richard E. Moore

*Attorney, Agent, or Firm*—Dressler, Goldsmith, Shore, Sutker & Milnamow, Ltd.

[57] ABSTRACT

A window latch that includes a handle portion secured to the window and a generally U-shaped latch member that is secured to the frame. The U-shaped latch member defines a projection in engagement with the handle to retain the window in the closed position. To open the latch, the legs of the U are moved toward each other to disengage the projection from the handle to permit the window to be moved to the open position.

2 Claims, 2 Drawing Sheets

LATCH ASSEMBLY

FIELD OF INVENTION

This invention relates to a latch mechanism for releasably securing a window, or the like, in position relative to a frame. The latch is resilient and flexible and thus can be readily operated to release or secure the window in place.

BACKGROUND OF THE INVENTION

Latch mechanisms of various types have long been employed, but for the most part they are subject to a number of deficiencies in that they comprise a plurality of parts which can become lost, broken, or separated. Also, they are often bulky and unwieldy and cannot be readily manipulated to open or close a window with ease.

SUMMARY OF THE INVENTION

In accordance with the present invention, there is provided a simple, yet highly efficient latch assembly that enables an operator to readily open or close a window. In an illustrated embodiment of the present invention, the latch mechanism comprises a handle portion that is secured to a window and a flexible latch member which engages with the handle portion to retain the window in the closed position until the latch is released from the handle portion. The handle is generally rectangular in shape and provides a hollow recess in which the operator places his hand to grip the window and move it between its open and closed positions. To accomplish this mode of operation, the handle assembly defines an abutment which is adapted to be engaged by a finger-like potion of a latch element. The interengagement of the abutment and finger portion retains the window in the closed position. The finger-like portion of the latch engaging member is located in an intermediate section of the latch member between a spring arm member that facilitates flexing of the latch member to permit interlocking and release thereof relative to the window handle and a press bar which is contacted by the operator to disengage the latch member from the handle. The other end of the spring arm is integral with a hinge portion that is disposed between the spring arm and a base member that is secured to the cab frame assembly. The press bar, when moved inwardly, moves the spring arm about its hinge portion to disengage the latch engaging member from the latch abutment to disconnect the latch member from the window handle to permit the window to be moved to the open position. When it is desired to close the window, the window is moved toward the closed position by the handle, and the handle portion rides up the cam surface defined by the spring arm until the latch abutment passes the latch engaging member, at which point the latch engaging member comes into contact with the recess formed by the handle to receive the latch abutment to retain the window in the closed position.

Other objects and advantages of the invention will be seen from the following drawings, in which.

Figure 1:
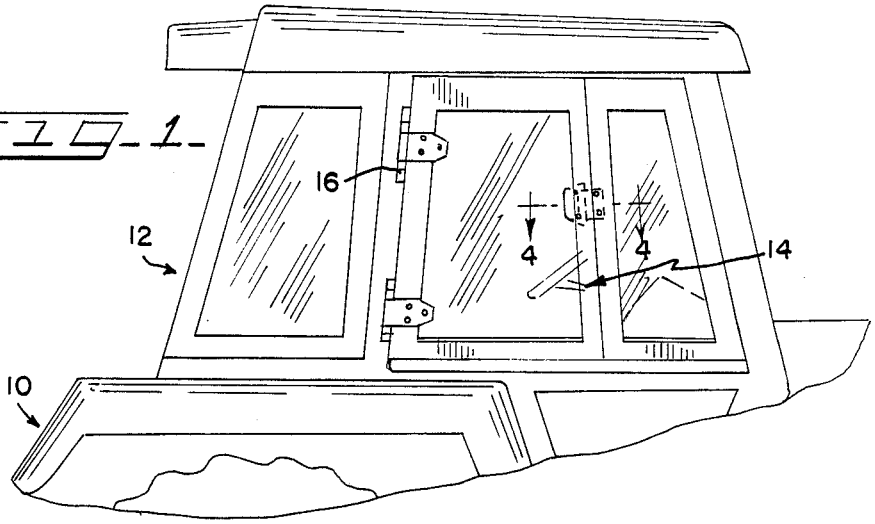
FIG. 1 is a partial view of a tractor cab showing a latch assembly latching a pivoted window of a cab relative to the cab.
Figure 2:
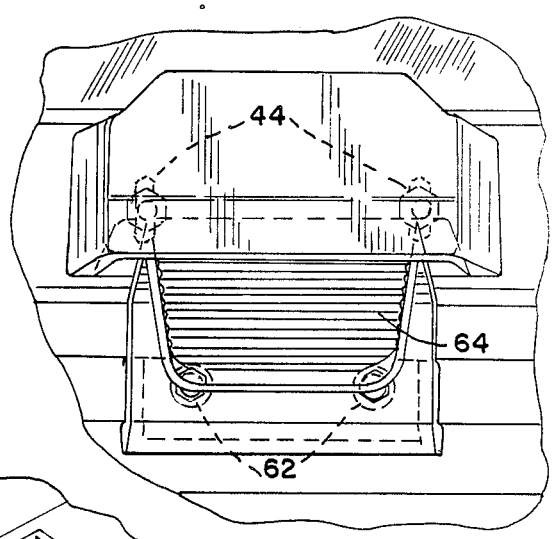
FIG. 2 is an enlarged view showing a front view of the latch assembly.
Figure 3:
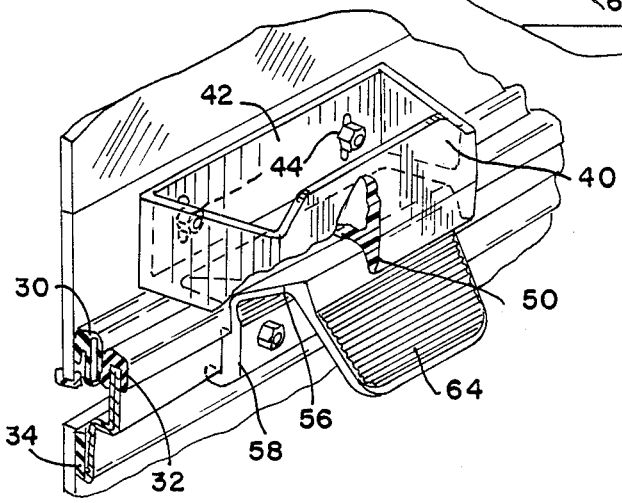
FIG. 3 is a perspective view partially broken away showing the latch in engagement with the handle portion to retain the window in the closed position as shown.

Referring first to FIG. 1, there is shown a tractor 10 having a cab 2 including a window assembly 14 that is pivotally connected at its side portion by hinge 16 to the cab 12. It is to be noted that while the window assembly and latch are shown in a particular orientation in FIG. 1, it can be located in other positions, depending on where the window is hinged and the design of the window. The illustrated embodiment is but merely one design that could be employed.

Figure 4:
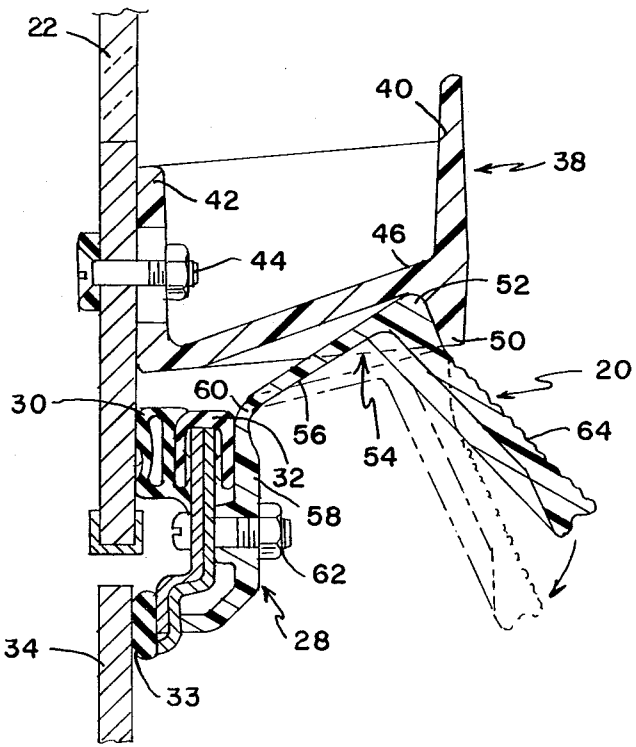
FIG. 4 is a cross-sectional view taken along line 4—4 of FIG. 1, showing the latch in the latch-engaging position in solid lines.

Referring now more specifically to FIG. 4, there is shown the deflectable latch assembly 20 which is used to maintain the pivoting window assembly 14 in the closed position. The window pane section 22 of the window assembly is a frameless glass. The door frame assembly 28 and window 22 when latched together by applicant's novel latching assembly are sealed relative to each other by sealing contact between the resilient compressible seals 30 and 32 secured to the door frame assembly 28. The door frame 28 is glued at 33 to the front glass assembly 34.

The window handle which forms part of the latch assembly 20 is designed to be gripped to move the window assembly 14 between the open and closed positions is indicated at 38 and is generally rectangular in shape, but is hollow to permit gripping to facilitate movement of the window assembly 14. Specifically, the handle defines an extending wall 40 that is gripped by the operator when the window is to be moved. The back wall 42 of the handle is secured to the window 22 by a pair of bolt and nut assemblies 44. The bottom wall 46 of the handle defines an upwardly sloping surface which leads to a recess 48 formed at the juncture of the wall 46 and a downwardly extending latch abutment 50. This recess 48 is designed to receive a latch engaging member 52 as described below.

Figure 5:
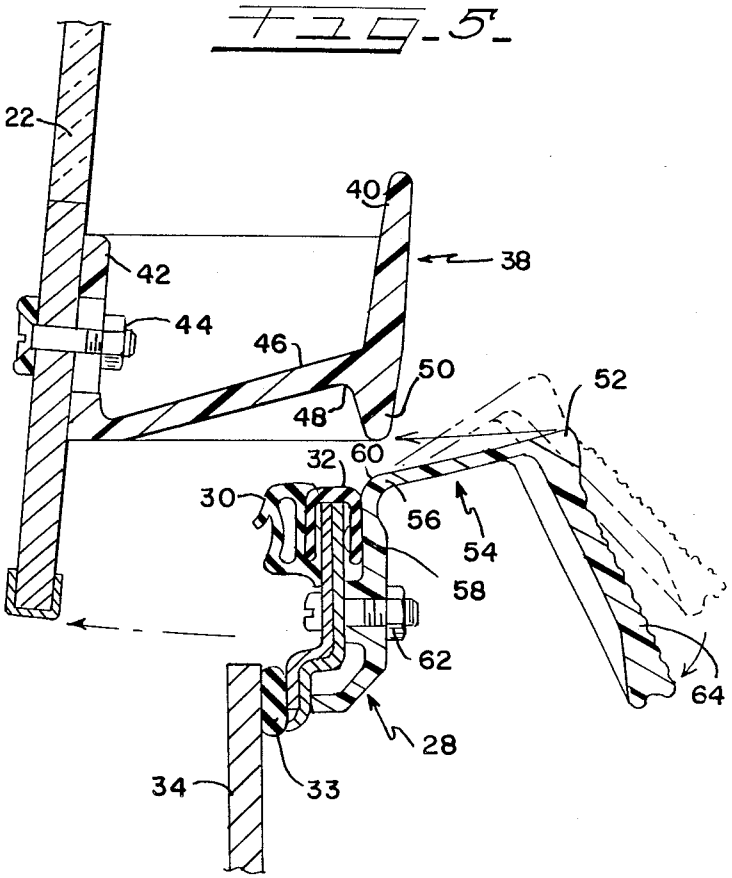
FIG. 5 shows the latch disengaged and the window moved to a partially open position.

The latch assembly further consists of the generally inverted U-shaped latch member 54 which defines at an intermediate portion the latch engaging member 52. As previously stated, the latch engaging member 52 fits into the recess 48 defined at the juncture of the latch abutment 50 and wall 46. The latch member 54 additionally includes a spring arm 56 which is connected to the latch base member 58 through a hinge section 60. The base 58 of the latch is secured to the door frame 28 by a pair of nut and bolt assemblies 62. Extending downwardly from the latch engaging member 52 is a serrated press bar 64 which when pressed moves it into the dotted-line position shown in FIG. 4. This forward movement of the press bar moves the latch engaging member 52 out of contact with the latch abutment 50, thus permitting the handle to be moved in a clockwise direction toward a fully open position as shown in FIG. 5. After the latch engaging member 52 disengages from the latch abutment 50 and the window is moved to the position as shown in FIG. 5, the latch will return to its normal position as shown in dotted lines in FIG. 5. When the window is to be closed, the abutment 50 of the handle portion rides up on the upper surface of the spring arm 56 until the latch engaging member 52 passes the abutment 50, after which the latch engaging member 52 moves into the recess 88 to latch the window in the closed position.

As previously mentioned, while the latch member 54 here is illustrated as an inverted U-shaped member, it would depend for its orientation on where it is located with respect to the window and whether or not the latch or handle is secured to the window or to the frame.

It is, of course, intended to cover any such variations or locations of the latch assembly and handle arrangement as covered by the appended claims.

What is claimed is:

1. A latch assembly for releasably securing a swingable window assembly to a frame assembly comprising a handle secured to one of said window and frame assemblies and a generally U-shaped latch member secured to the other of said assemblies, the handle is generally rectangular in configuration and defines an open area including a front wall to be gripped by the operator for moving the window between open and closed positions, and a latch abutment which is coextensive with the front wall of the handle, said latch member defining a base member which is secured to its respective assembly, a hinge area, a spring arm, a latch engaging member, and a serrated press bar which when engaged moves the latch engaging member out of contact with said abutment by permitting movement of the press bar about the hinge area defined by the latch engaging member adjacent to its base member for latching and unlatching said window.

2. A latch assembly in accordance with claim 1 in which the latch engaging member extends into a recess defined between the lower surface of said handle and said latch abutment on the handle to retain the window in the closed position.

* * * * *